US007362047B2

(12) United States Patent
Song et al.

(10) Patent No.: US 7,362,047 B2
(45) Date of Patent: Apr. 22, 2008

(54) INORGANIC ELECTROLUMINESCENT DISPLAY DEVICE AND METHOD OF MANUFACTURING THE SAME

(75) Inventors: Young-Woo Song, Suwon-si (KR); Yoon-Chang Kim, Suwon-si (KR); Jong-Seok Oh, Suwon-si (KR); Ji-Hoon Ahn, Suwon-si (KR); Sang-Hwan Cho, Suwon-si (KR); Joon-Gu Lee, Suwon-si (KR); So-Young Lee, Suwon-si (KR)

(73) Assignee: Samsung SDI Co., Ltd., Suwon (KR)

( * ) Notice: Subject to any disclaimer, the term of this patent is extended or adjusted under 35 U.S.C. 154(b) by 218 days.

(21) Appl. No.: 11/194,563

(22) Filed: Aug. 2, 2005

(65) Prior Publication Data

US 2006/0055294 A1 Mar. 16, 2006

(30) Foreign Application Priority Data

Aug. 3, 2004 (KR) ..... 10-2004-0061086

(51) Int. Cl.
*H01J 1/62* (2006.01)

(52) U.S. Cl. ..... 313/506; 313/498

(58) Field of Classification Search ..... None
See application file for complete search history.

(56) References Cited

U.S. PATENT DOCUMENTS 6,215,244 B1 * 4/2001 Kuribayashi et al. ..... 313/505
6,888,305 B2 * 5/2005 Weaver ..... 313/506
2003/0127974 A1 * 7/2003 Miyazawa ..... 313/504
2004/0169465 A1 * 9/2004 Do et al. ..... 313/506

FOREIGN PATENT DOCUMENTS

| | | |
|---|---|---|
| JP | 1997-73983 | 3/1997 |
| JP | 11-283751 | 10/1999 |
| JP | 2004-127746 A1 | 4/2004 |
| KR | 1020030026450 A1 | 4/2003 |

OTHER PUBLICATIONS

The refractive index of thin solid films, S K J Al-Ani, J Beynon, Phys Educ. 20 1985, p. 274-277.*

* cited by examiner

*Primary Examiner*—Vip Patel
(74) *Attorney, Agent, or Firm*—H.C. Park & Associates, PLC

(57) ABSTRACT

An inorganic electroluminescent display device including a substrate, a first electrode formed on the substrate, a first insulation layer formed on the first electrode, a luminescent layer formed on the first insulation layer, a second insulation layer formed on the luminescent layer, and a second electrode formed on the second insulation layer. A diffraction grid is provided at at least one of a first interface between the first insulation layer and the luminescent layer and a second interface between the second insulation layer and the luminescent layer.

12 Claims, 6 Drawing Sheets

INORGANIC ELECTROLUMINESCENT DISPLAY DEVICE AND METHOD OF MANUFACTURING THE SAME

CROSS REFERENCE TO RELATED APPLICATION

This application claims priority to and the benefit of Korean Patent Application No. 10-2004-0061086, filed on Aug. 3, 2004, which is hereby incorporated by reference for all purposes as if fully set forth herein.

BACKGROUND OF THE INVENTION

1. Field of the Invention

The present invention relates to an inorganic electroluminescent display device and a method of manufacturing the same, and more particularly, to an inorganic electroluminescent display device having improved light emission efficiency.

2. Discussion of the Background

Generally, an external light coupling efficiency $\eta_{ex}$ of an inorganic electroluminescent display device is given by:

$$\eta_{ex} = \eta_{in} \cdot \eta_{out}, \quad \text{[Equation 1]}$$

where, $\eta_{in}$ and $\eta_{out}$ denote an internal light coupling efficiency and an output coupling efficiency, respectively. The internal light coupling efficiency $\eta_{in}$ is determined by self-elimination within each layer, and the output coupling efficiency $\eta_{out}$ is determined by total reflection in each layer (i.e., failure to externally output light due to total reflection generated at an interface because the incident angle exceeds a critical angle when the light is incident from a medium having a higher refractive index to a medium having a lower refractive index). As described below, since the inorganic electroluminescent display device's luminescent layer has a higher refractive index than an insulation layer, the light coupling efficiency is usually determined by total reflection at the interface between the luminescent layer and the insulation layer.

In a conventional inorganic electroluminescent display device shown in FIG. 1, assuming that the light generated in the luminescent layer 140 passes through a first insulation layer 130, a first electrode 120, and a substrate 110 before being transmitted to the air, the output coupling efficiency $\eta_{out}$ in consideration of the total reflection between each layer may be expressed as:

$$\frac{1}{2}\left(\frac{N_{out}}{N_{in}}\right)^2, \quad \text{[Equation 2]}$$

where, N denotes an refractive index of each layer. Some examples of the indices of refraction N of the layers used in a typical inorganic electroluminescent display device are shown in the following Table 1.

TABLE 1

| | Case I | | Case II | | Case III | |
|---|---|---|---|---|---|---|
| | N | Thickness | N | Thickness | N | Thickness |
| 2nd Insulation Layer | 1.6 | 200 nm | 1.9 | 200 nm | 2.5 | 200 nm |
| Luminescent Layer | 2.5 | 800 nm | 2.5 | 800 nm | 2.5 | 800 nm |
| 1st Insulation Layer | 1.6 | 200 nm | 1.9 | 200 nm | 2.5 | 200 nm |
| 1st Electrode | 1.9 | 200 nm | 1.9 | 200 nm | 1.9 | 200 nm |
| Substrate | 1.5 | 700 μm | 1.5 | 700 μm | 1.5 | 700 μm |

In Table 1, the conventional luminescent layer typically comprises ZnS. Additionally, for the first and second insulation layers, $SiO_2$ and $Al_2O_3$ are used in Case I, SiNx is used in Case II, and ZnS is used in Case III.

Then, for Case I, II, and III, ratios of the light incident to a layer to the light eliminated within the layer without being externally output are measured. Table 2 shows the results.

TABLE 2

| | Case I | Case II | Case III |
|---|---|---|---|
| Luminescent Layer Mode | 83.3% | 77.1% | 77.6% |
| 1st Insulation Layer Mode | 5.3% | 11.9% | |
| 1st Electrode Mode | 2.3% | | 7.9% |
| Substrate Mode | 1.7% | 5.3% | 4% |
| Ratio of Light Output to External | 7.4% | 5.7% | 10.5% |

In Table 2, the luminescent layer mode refers to a ray path caused by total reflection at an interface between the luminescent layer 140 and the first insulation layer 130. Similarly, the first insulation layer mode refers to a ray path caused by total reflection at an interface between the first insulation layer 130 and the first electrode 120, the first electrode mode refers to a ray path caused by total reflection at an interface between the first electrode 120 and the substrate 110, and the substrate mode refers to a ray path caused by total reflection at an interface between the substrate 110 and the air.

The numerical values of Table 2 were obtained using a finite difference time domain (FDTD) simulator, which accurately calculates Maxwell's equations and may ensure high reliability.

Referring to Table 2, which shows light coupling efficiency in consideration of optical properties of layers in an inorganic electroluminescent device, the amount of light transmitted to the first layer is 30% or less of the total light for Cases I and II, which is typical in the conventional art. This is caused by total reflection generated when light is incident from the luminescent layer 140 to the first insulation layer 130 (i.e., the luminescent layer mode). Also, for Case III, the light coupling efficiency is dominated by the total reflection at an interface between the first insulation layer 130 and the first electrode 120 (i.e. the 1st insulation layer mode).

Consequently, for all three cases, the amount of externally outputted light is reduced to about 10% of the original amount of generated light, as shown in the last row of Table 2. Therefore, the optical loss and luminance reduction in a corresponding display device is significant.

There have been several attempts to solve this optical loss and luminance reduction problem. For example, a supply voltage may be increased. While this may improve luminance, it adds complications for a driver IC. Also, increasing the supply voltage decreases the lifespan of main components and increases power consumption. Therefore, techniques have been proposed to provide improved luminance without increasing the driving voltage or with a decreased driving voltage.

For example, Japanese patent application publication No. 9-73983 discloses an electroluminescent display device including a prism lens sheet comprising an acrylic resin, in which a plurality of prisms have length-directional axes that are in parallel with one another. In this case, light incident on an interface between a transparent substrate and the air at an angle exceeding a critical angle experiences less total reflection due to the prism lens, where the incident angle is made less than the critical angle at each side. Also, luminance is increased in a predetermined direction by outputting light to the corresponding direction. However, according to this technique, optical loss may still be caused by reflection in the prism lens. Also, sharpness may be reduced due to overlapped images. Additionally, since most of the light that is not externally outputted due to total reflection is generated in the interface between the luminescent layer and the insulation layer, improvement of the light coupling efficiency may be slight.

Japanese patent publication No. 11-283751 discloses an organic electroluminescent display device having a diffraction grid on a reflection electrode. Here, the effect of total reflection may be reduced by using a diffraction grid structure formed on the reflection electrode so that light that has experienced total reflection at an interface may be incident to the interface at an angle smaller than a critical angle. However, though this technique may be effective when applied to an organic electroluminescent display device in which most of the total reflection is generated at an interface between the substrate and the electrode, it is not effective when applied to an inorganic electroluminescent display device in which most of the total reflection is generated at an interface between the luminescent layer and the insulation layer.

SUMMARY OF THE INVENTION

The present invention provides an inorganic electroluminescent display device having improved light coupling efficiency and a method of manufacturing the same.

Additional features of the invention will be set forth in the description which follows, and in part will be apparent from the description, or may be learned by practice of the invention.

The present invention discloses an inorganic electroluminescent display device including a substrate, a first electrode formed on the substrate, a first insulation layer formed on the first electrode, a luminescent layer formed on the first insulation layer, a second insulation layer formed on the luminescent layer, and a second electrode formed on the second insulation layer. A diffraction grid is provided at at least one of a first interface and a second interface. The first interface is between the first insulation layer and the luminescent layer, and the second interface is between the second insulation layer and the luminescent layer.

The present invention also discloses a method of manufacturing an inorganic electroluminescent display device including forming a first electrode on a substrate, forming a first insulation layer on the first electrode, forming a diffraction grid on the first insulation layer, forming a luminescent layer on the diffraction grid, forming a second insulation layer on the luminescent layer, and forming a second electrode on the second insulation layer.

The present invention also discloses a method of manufacturing an inorganic electroluminescent display device including forming a first electrode on a substrate, forming a first insulation layer on the first electrode, forming a luminescent layer on the first insulation layer, forming a diffraction grid on the luminescent layer, forming a second insulation layer on the diffraction grid, and forming a second electrode on the second insulation layer.

The present invention also discloses a method of manufacturing an inorganic electroluminescent display device including forming a first electrode on a substrate, forming a first insulation layer on the first electrode, forming a first diffraction grid on the first insulation layer, forming a luminescent layer on the first diffraction grid, forming a second diffraction grid on the luminescent layer, forming a second insulation layer on the second diffraction grid, and forming a second electrode on the second insulation layer.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE ILLUSTRATED EMBODIMENTS

The present invention will now be described more fully with reference to the accompanying drawings, in which exemplary embodiments of the invention are shown.

Figure 2:
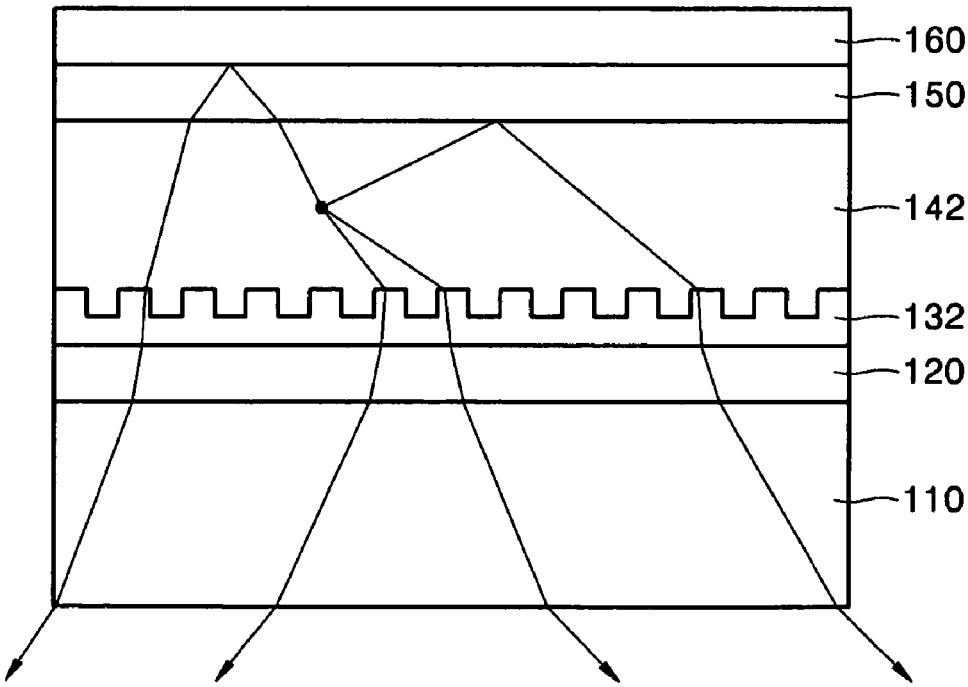
FIG. 2 is a cross-sectional view showing an inorganic electroluminescent display device according to an embodiment of the present invention.

FIG. 2 is a cross-sectional view showing an inorganic electroluminescent display device according to a first embodiment of the present invention.

As FIG. 2 shows, an inorganic electroluminescent display device according to a first embodiment of the present invention may include a substrate 110, a first electrode 120, a first insulation layer 132, a luminescent layer 142, a second insulation layer 150, and a second electrode 160, which has a different polarity from the first electrode 120. Further, a diffraction grid may be provided at an interface between the first insulation layer 132 and the luminescent layer 142. Although not shown in the drawing, a shielding member may be further provided on the second electrode 160 to shield the underlying layers. Hereinafter, for the sake of convenience, embodiments of the present invention will be described without referring to the shielding member.

The substrate 110 may be made of a transparent glass material comprising, for example, $SiO_2$. Although not shown in the drawing, a buffer layer made of, for example, $SiO_2$ may be provided on the substrate 110 to provide a flat surface and prevent impurities from permeating layers above the buffer layer. The substrate 110 may also be made of a plastic material, such as a flexible polymer.

The first electrode 120 may be made of a transparent conductive material such as indium tin oxide (ITO) and patterned using a photolithography method. For a passive matrix (PM) device, the first electrode 120 may be patterned in a stripe shape having a predetermined interval, whereas, for an active matrix (AM) device, it may be patterned in a shape associated with the pixel pattern. Also, the AM inorganic electroluminescent display device further includes a thin film transistor (TFT) layer provided with at least one TFT between the first electrode 120 and the substrate 110, and the first electrode 120 is electrically connected to the TFT layer. The aforementioned structures may be similarly applied to all embodiments of the present invention, which will be described below.

The first electrode 120 made of an ITO film may serve as an anode, and it may be coupled to a first external electrode terminal (not shown).

The second electrode 160 is positioned above the first electrode 120. The second electrode 160 may be reflective, and it may be made of aluminum/calcium. Also, the second electrode 160 may serve as a cathode, and it may be coupled to a second external electrode terminal (not shown).

The second electrode 160 may be formed in a stripe shape that is perpendicular to the pattern of the first electrode 120 for a PM device, whereas it may be formed in a shape associated with the pixel pattern for an AM device. Further, the second electrode 160 may be formed on an entire surface of the active area for displaying images in an AM device.

Polarities of the first and second electrodes 120 and 160 may be reversed.

The luminescent layer 142, the first insulation layer 132, and the second insulation layer 150 are arranged between the first electrode 120 and the second electrode 160. Depending on materials of these layers, the electroluminescent display device may be an organic or inorganic electroluminescent display device.

In the inorganic electroluminescent display device, the luminescent layer 142 may be made of a material such as a metallic sulfide such as ZnS, SrS and CaS, an alkaline earth potassium sulfide such as $CaGa_2S_4$ and $SrGa_2S_4$, and an alkaline rare-earth metal or a transition metal such as Mn, Ce, Tb, Eu, Tm, Er, Pr, and Pb.

The shielding member (not shown) may be arranged above the second electrode 160. The shielding member may be a metal cap having a moisture absorbent in it, or the shielding member may be formed as a substrate.

The inorganic electroluminescent display device according to a first embodiment of the present invention may be a rear-emission type display device in which light emitted from the luminescent layer 142 is output toward the substrate 110, a front-emission type, or a bi-directional emission type.

In the aforementioned structure, when light generated in the luminescent layer 142 is incident to the first insulation layer 132, the diffraction grid provided at their interface allows the amount of light experiencing total reflection to be reduced. In other words, if the diffraction grid is not provided, light generated in the luminescent layer 142 may be incident to the first insulation layer at an angle exceeding a critical angle, thereby causing total reflection. However, according to an embodiment of the present invention including the diffraction grid, light generated in the luminescent layer 142 may be transmitted to the first insulation layer 132 with little total reflection and then externally outputted, thereby providing higher luminance. Additionally, even when light generated in the luminescent layer 142 is incident to the second insulation layer 150 at an angle exceeding a critical angle, the light may be diffracted in the diffraction grid and then incident to the first insulation layer 132 at an angle smaller than a critical angle. Therefore, the light may be transmitted through the first insulation layer 132 with little total reflection. Consequently, it is possible to improve light coupling efficiency. Additionally, according to a first embodiment of the present invention, it is possible to further improve light coupling efficiency by forming the second electrode 160 to be reflective.

The diffraction grid may be formed by patterning a surface of the first insulation layer 132 facing the luminescent layer 142, as shown in FIG. 2, or it may be formed as a separate layer interposed between both layers. However, considering light coupling efficiency, it may be preferable to form the diffraction layer by patterning the interface between the luminescent layer 142 and the first insulation layer 132 to have steps or protrusions, as shown in FIG. 2.

Figure 3:
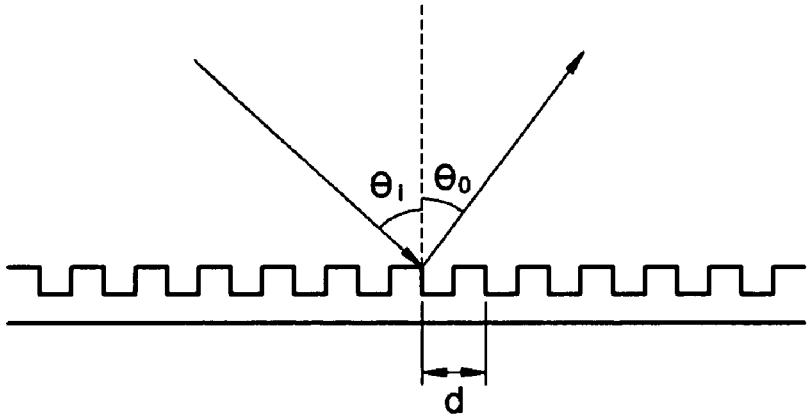
FIG. 3 is a conceptual cross-sectional view showing a diffraction grid and an optical path variation thereof.

FIG. 3 is a conceptual cross-sectional view showing a diffraction grid and an optical path variation thereof.

As shown in FIG. 3, when light incident at an angle $\theta_i$ is reflected on the diffraction grid, the relationship among a diffraction order k, a reflection angle $\theta_o$, an interval d between protrusions on the diffraction grid, the wavelength $\lambda$ of the incident light, and an refractive index n is given by:

$$nd(\sin\theta_i - \sin\theta_o) = k\lambda \qquad \text{[Equation 3]}$$

Equation 3 shows that the reflection angle $\theta_o$ may be adjusted by controlling the interval between protrusions formed on the diffraction grid. Therefore, by controlling the interval between protrusions, it is possible to allow light incident at an angle exceeding a critical angle to be diffracted and incident to an opposite interface at an angle smaller than the critical angle.

Figure 1:
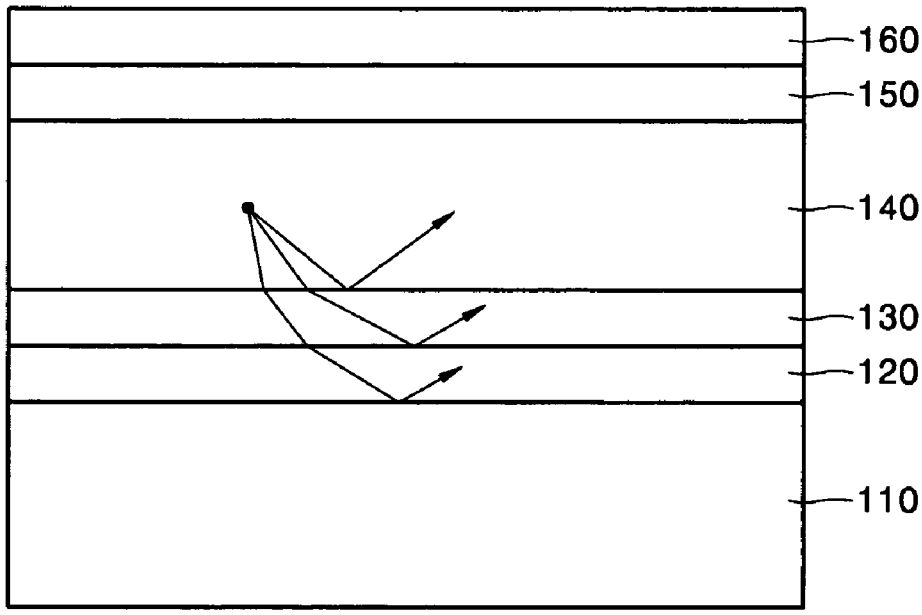
FIG. 1 (PRIOR ART)
FIG. 1 is a cross-sectional view showing a conventional inorganic electroluminescent display device.

On the aforementioned theoretical basis, in order to compare light coupling efficiency between the inorganic electroluminescent display device according to a first embodiment of the present invention and a conventional device, a conventional inorganic electroluminescent display device shown in FIG. 1 was manufactured as a first comparison example according to the following procedures.

First, the first electrode 120 was formed on the substrate 110 using an ITO film, and the first insulation layer 130 was formed by depositing about a 500 nm thick $SiO_2$ layer on the first electrode 120. In this case, the luminescent layer 140 is about 8,000 Å thick, and rapid thermal annealing was performed in a temperature of about 600° C. for about three minutes. Subsequently, $Al_2O_3$ and Al were deposited to form the second insulation layer 150 and the second electrode 160, respectively.

An inorganic electroluminescent display device according to a first embodiment of the present invention shown in FIG. 2 was manufactured according to the following procedures. First, the first electrode 120 was formed on the substrate 110 using an ITO film. Then, the first insulation layer 132 having a diffraction grid was formed by depositing about a 500 nm thick $SiO_2$ layer on the first electrode 120 by a plasma enhanced chemical vapour deposition (PECVD) method and patterning it in a dotted nanostructure having a size ratio of about 50%, an interval of about 350 nm, and a depth of about 200 nm. Subsequently, similar to the first comparison example, the luminescent layer 142 was formed by a sputtering method using ZnS:Tb. In this case, the luminescent layer 142 is about 8000 Å thick, and rapid thermal annealing was performed in a temperature of about 600° C. for about three minutes. Subsequently, $Al_2O_3$ and Al were deposited to form the second insulation layer 150 and the second electrode 160, respectively.

Finally, light coupling efficiency was measured for the device manufactured according to the first comparison example and the device manufactured according to the first embodiment of the present invention. The light coupling efficiency of the first embodiment of the present invention was about 5.6 times that of the first comparison example.

As a second comparison example, a conventional inorganic electroluminescent display device was manufactured including a first insulation layer 130 made of silicon nitride (SiNx), unlike the first comparison example. In other words, the inorganic electroluminescent display device according to the second comparison example was manufactured in a similar structure as the first comparison example, except that the first insulation layer 130 is made of silicon nitride (SiNx). In this case, the light coupling efficiency of the first embodiment of the present invention was about 4 times that of the second comparison example.

On the other hand, a typical organic electroluminescent display device includes a first electrode, a hole injection layer, a hole transport layer, a luminescent layer, an electron transport layer, an electron injection layer, and a second electrode sequentially stacked upon one another. Also, all the layers may be made of organic films, and a refractive index of the first electrode made of organic material or ITO is similar to that of an inorganic electroluminescent display device. Therefore, total reflection is predominantly generated at an interface between the first electrode made of ITO and a substrate made of a glass material. Consequently, if a diffraction grid according to the present invention is incorporated into a conventional organic electroluminescent display device, it would be more effective to provide the diffraction grid at the interface between the first electrode and the substrate, unlike the inorganic electroluminescent display device.

As a third comparison example, a conventional organic electroluminescent display device was manufactured without the diffraction grid by forming about a 70 nm thick TPD film and about an 80 nm thick Alq3 film on a glass substrate having about an 100 nm thick ITO film, forming about a 10 Å thick LiF film, and then forming about a 1,000 Å thick cathode made of Al. Its light coupling efficiency was measured to be about 5 cd/A.

As a fourth comparison example, a conventional organic electroluminescent display device similar to the third comparison example was manufactured by interposing a two-dimensional diffraction grid and a flattening layer between the interface between the first electrode and the substrate. The two-dimensional diffraction grid was formed in a dotted nanostructure made of $SiO_2$ with an interval of about 350 nm, a size ratio of about 0.5, and a depth of about 300 nm, and the flattening layer was made of about an 800 nm thick SiNx layer by a PECVD method to flatten the diffraction grid. The structure formed above the first electrode was similar to that of the third comparison example. The light coupling efficiency of this device was measured to be about 8 cd/A.

To summarize the aforementioned examples, the light coupling efficiency of an inorganic electroluminescent display device according to a first embodiment of the present invention was about 4 to 6 times that of the first comparison example. Also, the light coupling efficiency of organic electroluminescent display device according to the fourth comparison example was about 1.6 times that of the organic electroluminescent display device according to the third comparison example. Therefore, the first embodiment of the present invention is more effective when applied to an inorganic electroluminescent display device.

Figure 4:
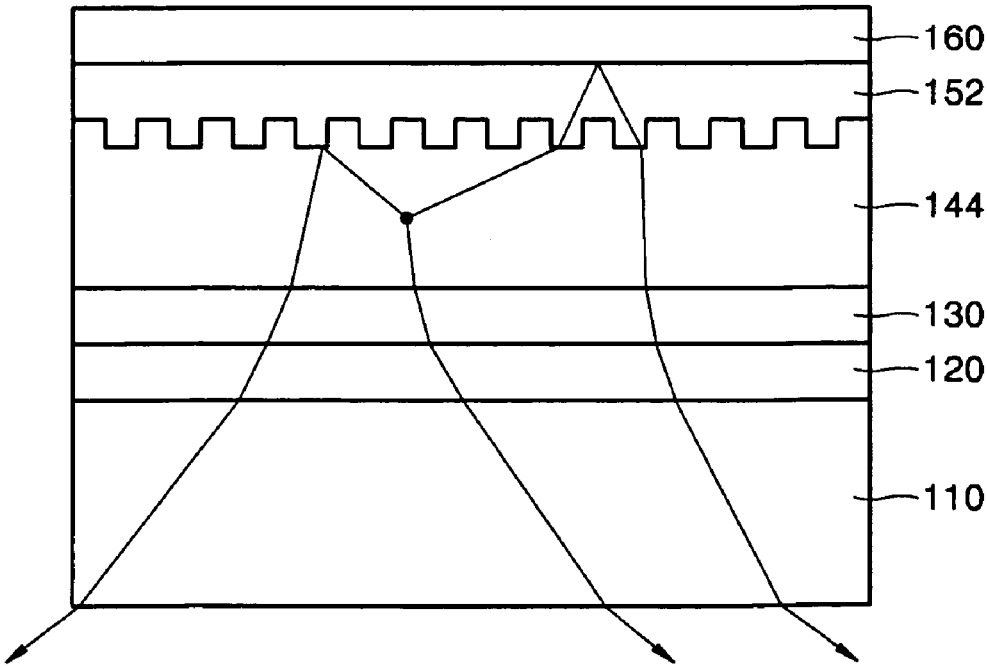
FIG. 4 is a cross-sectional view showing an inorganic electroluminescent display device according to another embodiment of the present invention.

FIG. 4 is a cross-sectional view illustrating an inorganic electroluminescent display device according to a second embodiment of the present invention, utilizing a basic principle of Equation 3.

The inorganic electroluminescent display device according to a second embodiment of the present invention includes a first electrode 120, a first insulation layer 130, a luminescent layer 144, a second insulation layer 152, and a second electrode 160 arranged on a substrate 110. Further, a diffraction grid is provided at an interface between the luminescent layer 144 and the second insulation layer 152. In this structure, light incident from the luminescent layer 144 to the second insulation layer 152 at an angle exceeding a critical angle experiences total reflection without the diffraction grid. Then, the reflected light would also be incident to the first insulation layer 130 at an angle exceeding a critical angle to experience total reflection again. Accordingly, this light is not externally outputted. However, if a diffraction grid is provided at the interface between the luminescent layer 144 and the second insulation layer 152 as shown in FIG. 4, light would be diffracted in the interface and then incident to the first insulation layer 130 at an angle smaller than a critical angle, so that the light may be externally outputted. The second electrode 160 may be formed to be reflective to more improve light coupling efficiency.

The diffraction grid may be formed by providing a separate layer between the luminescent layer 144 and the second insulation layer 152, or it may be formed by patterning a surface of the luminescent layer 144. Patterning the surface of the luminescent layer 144 may provide higher light coupling efficiency than forming the diffraction grid as a separate layer.

Figure 5:
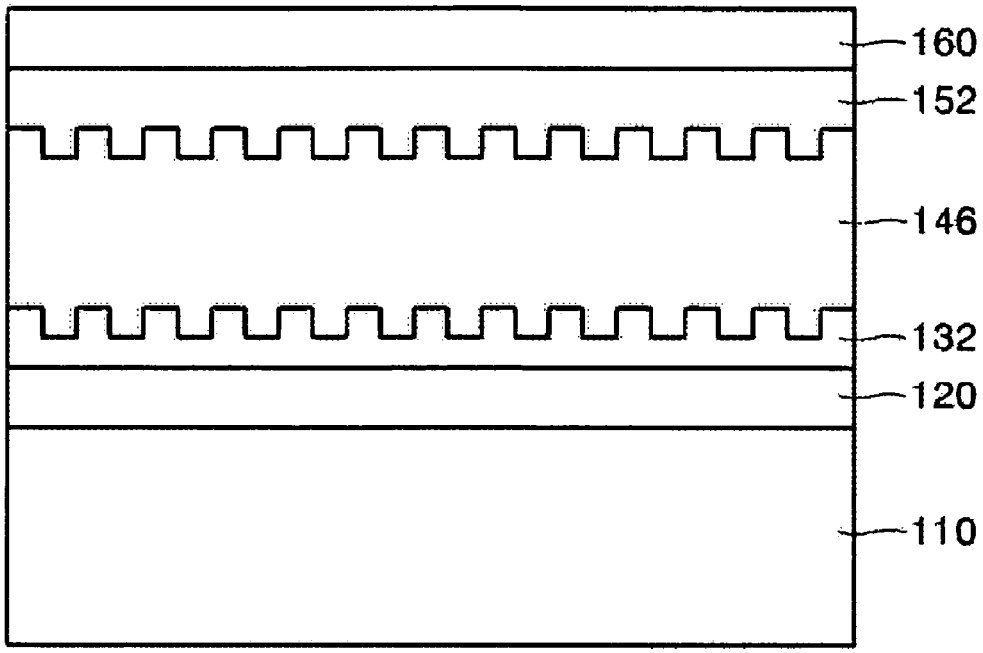
FIG. 5 is a cross-sectional view showing an inorganic electroluminescent display device according to still another embodiment of the present invention.

FIG. 5 is a cross-sectional view showing an inorganic electroluminescent display device according to a third embodiment of the present invention.

As shown in FIG. 5, the inorganic electroluminescent display device according to a third embodiment of the present invention includes a first electrode 120, a first insulation layer 132, a luminescent layer 146, a second insulation layer 152, and a second electrode 160 formed on a substrate 110. Further, a first diffraction grid is provided at an interface between the luminescent layer 146 and the first insulation layer 132, and a second diffraction grid is provided at an interface between the luminescent layer 146 and the second insulation layer 152. In this structure, when light generated in the luminescent layer 146 is incident to the second insulation layer 152 at an angle exceeding a critical angle, the light is not totally reflected but diffracted by the diffraction grid formed at the interface between the luminescent layer 146 and the second insulation layer 152 so that the light may be incident to the first insulation layer 132 at an angle smaller than a critical angle. Therefore, it is possible to improve light coupling efficiency. Furthermore, when light generated in the luminescent layer 146 is incident to the first insulation layer 132 at an angle exceeding a critical angle, the light is not totally reflected but diffracted by the diffraction grid formed at the interface between the luminescent layer 146 and the first insulation layer 132 so that the light may be transmitted through the first insulation layer 132. Therefore, it is possible to more improve light coupling efficiency.

The aforementioned first through third embodiments of the present invention have been described by exemplifying only a rear-emission type device in which the second electrode 160 is reflective. However, embodiments of the present invention may be applied to various types of electroluminescent display devices, such as a front-emission type, in which the first electrode 120 is reflective, and a bidirectional-emission type, in which both of the first and second electrodes are transparent.

Figure 6:
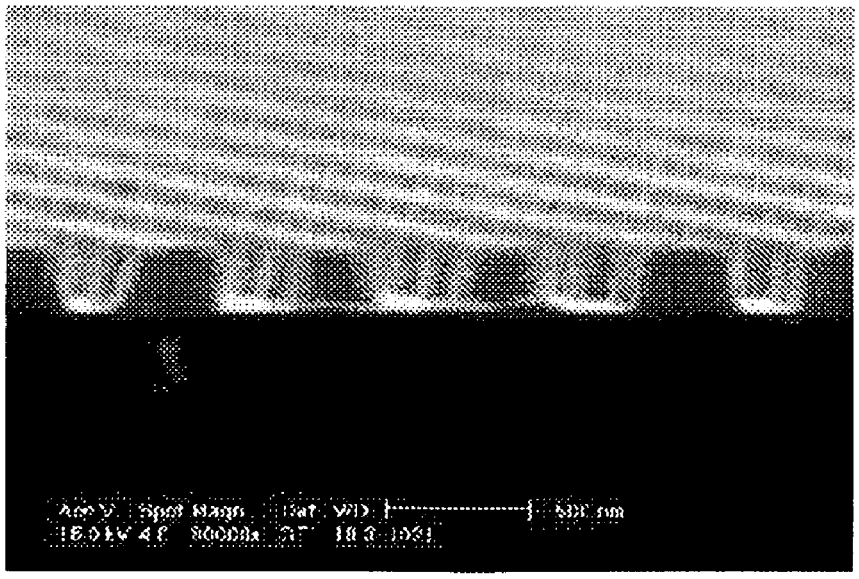
FIG. 6 is a magnified picture showing a diffraction grid having two-dimensional protrusions in an inorganic electroluminescent display device according to still another embodiment of the present invention.

FIG. 6 is a magnified picture showing a diffraction grid having two-dimensional protrusions in an inorganic electroluminescent display device according to a fourth embodiment of the present invention.

The diffraction grid has protrusions formed in a substantially constant interval. The protrusions may be in a stripe shape. In this case, light is not diffracted in parallel with the stripe. Therefore, if the protrusions are formed in a two-dimensional array shape, possibility of diffraction may be increased so that light coupling efficiency may improve. The protrusions may be provided in various other shapes, such as a hexahedron or cylinder shape.

Since Equation 3 shows that an interval between the protrusions of the diffraction grid determines the light transmission angle, it is preferable that the interval between the protrusions of the diffraction grid is about ¼ to 4 times the wavelength of the light generated in the luminescent layer. If the interval exceeds this value, the amount of diffraction decreases, so that the angle of diffracted light may not be within a range of a critical angle. On the contrary, if the interval is smaller than this value, the amount of the light passing through the diffraction grid decreases, which may reduce light coupling efficiency.

In the aforementioned embodiments of the present invention, the first and second insulation layers may have indices of refraction within a range of about 1.5 to 2.5. Referring to FIG. 4, the critical angle decreases as the refractive index of the insulation layer 130 decreases, so that the amount of light experiencing total reflection increases when light generated in the luminescent layer 144 is incident to the insulation layer 130. Therefore, if the refractive index of the insulation layer 130 is lower than about 1.5, light coupling efficiency may be significantly reduced. Hence, the refractive index of the insulation layer is preferably higher than about 1.5.

Additionally, since the amount of light experiencing total reflection when incident to the first insulation layer 130 decreases as the refractive index of the first insulation layer 130 increases, the refractive index of the first insulation layer 130 is preferably large. However, since the refractive index of the first electrode 120 is about 1.9, the amount of light experiencing total reflection when incident from the first insulation layer 130 to the first electrode 120 increases as the refractive index of the first insulation layer 130 increases within a range higher than about 1.9. Therefore, a limitation of the refractive index of the first insulation layer 130 may be desirable. Hence, the refractive index of the first insulation layer 130 may be lower than about 2.5 to correspond to that of ZnS, which has been usually used for the luminescent layer 144.

An oxide or sulphide material may be used for an insulation material to provide such a range of the refractive index. For example, the insulation layer may comprise silicon oxide, aluminium oxide, hafnium oxide, and oxide of silicon nitride. Further, the insulation layer is preferably transparent.

Figure 7:
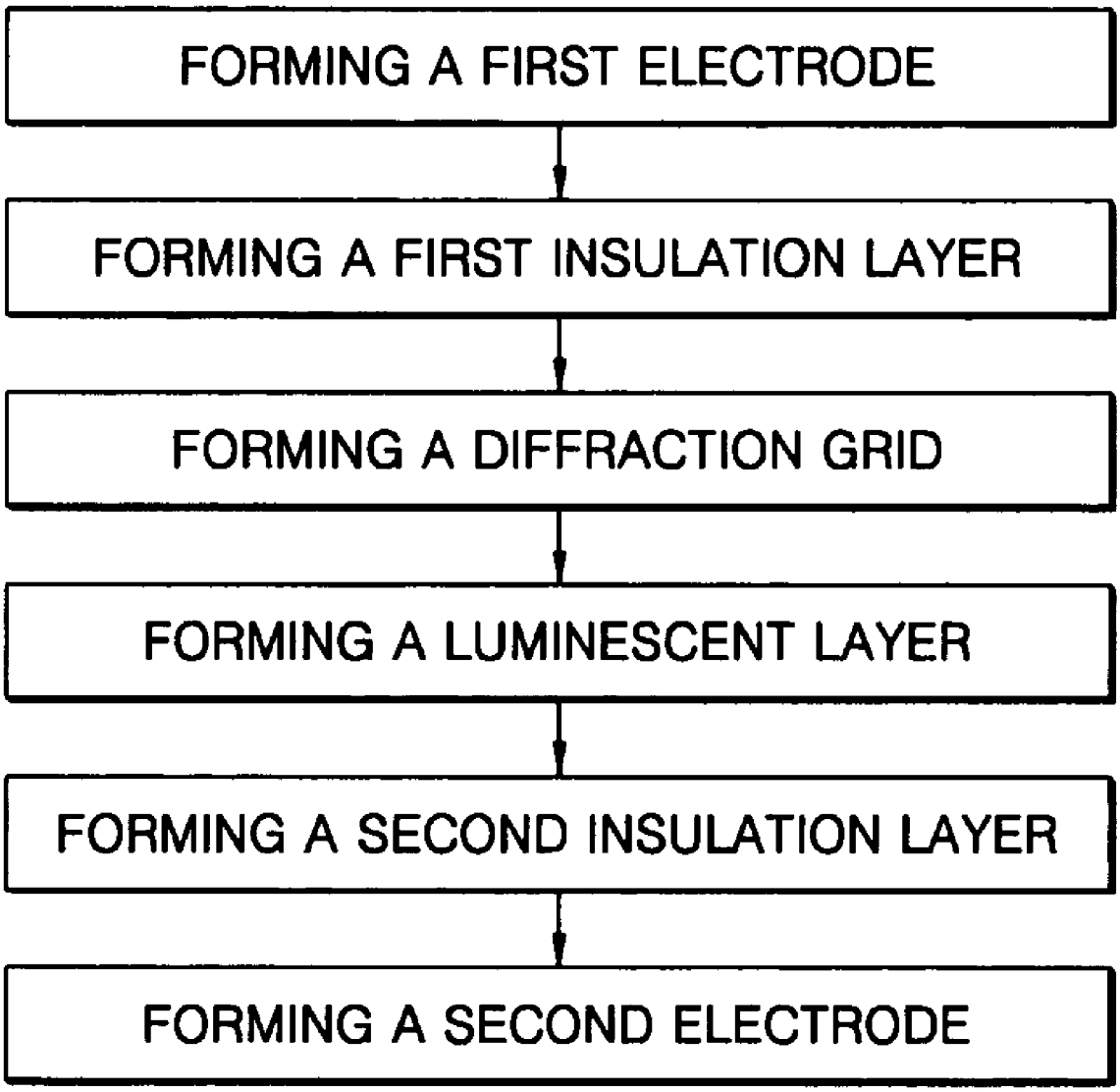
FIG. 7 is a flowchart showing a process for manufacturing an inorganic electroluminescent display device according to still another embodiment of the present invention.
Figure 8:
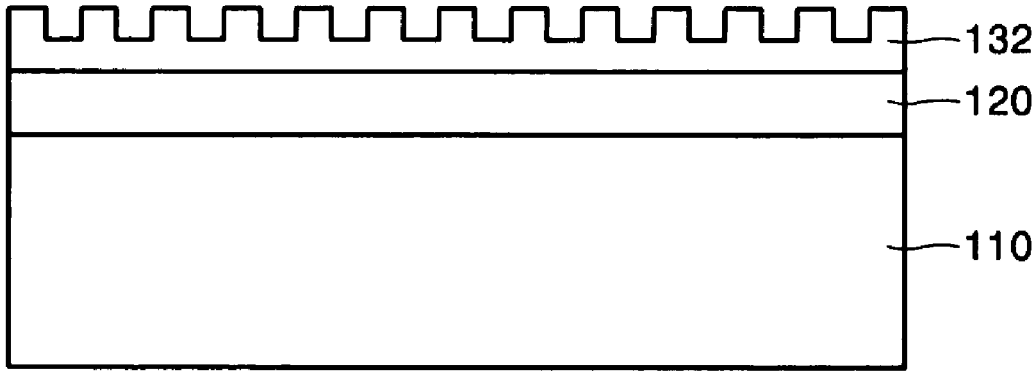
FIG. 8 and FIG. 9 are cross-sectional views for describing a process for manufacturing an inorganic electroluminescent display device according to still another embodiment of the present invention.
Figure 9:
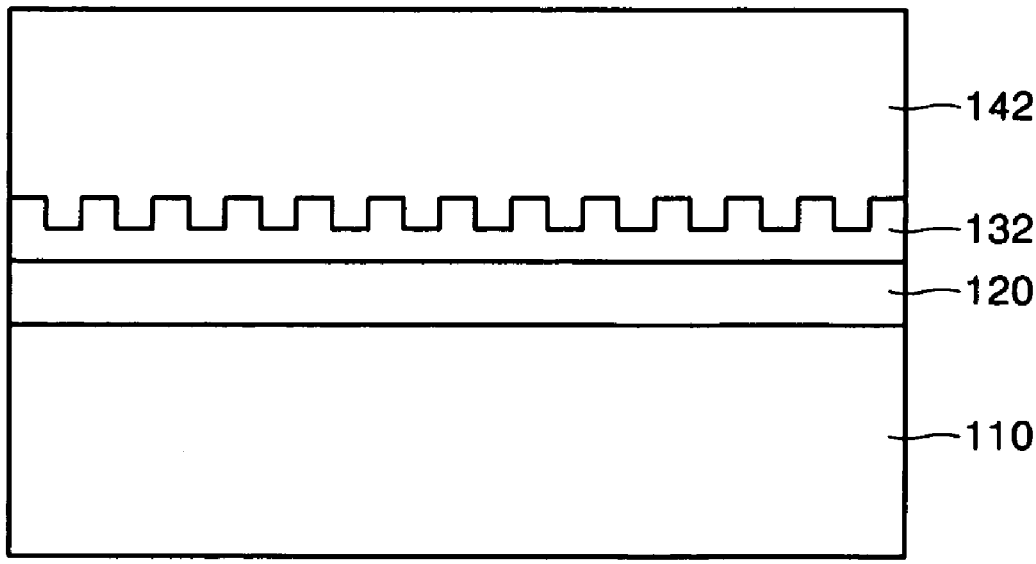

FIG. 7 is a flowchart showing a process for manufacturing an inorganic electroluminescent display device according to a fifth embodiment of the present invention, and FIG. 8 and FIG. 9 are cross-sectional views for describing a process for manufacturing an inorganic electroluminescent display device according to the fifth embodiment of the present invention.

The structure shown in FIG. 8 may be manufactured by the following procedures. First, the first electrode 120 may be formed on the substrate 110 by a sputtering method and patterned. Then, the first insulation layer made of silicon oxide may be formed thereon by a chemical vapour deposition method. Subsequently, a thin film made of Cr or Si may be formed on the first insulation layer by a sputtering method, and a positive photo-resist is coated thereon. The photo-resist may be patterned by an electron beam, a laser hologram, or a phase mask method and then etched by a developer. Then, the first insulation layer may be etched by, for example, a reactive ion etching method, to form a diffraction grid.

In this method, the upper surface of the first insulation layer 132 may be formed in the shape of the diffraction grid, and the luminescent layer 142 and the second electrode may be provided thereon as shown in FIG. 9 and FIG. 2.

Figure 10:
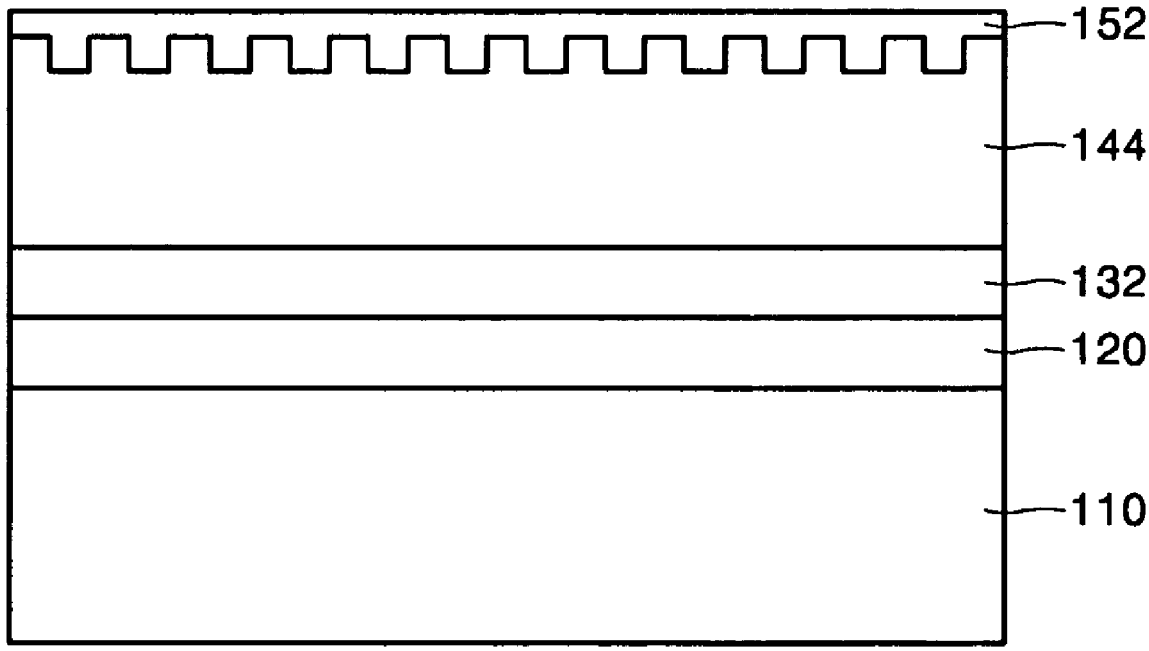
FIG. 10 is a cross-sectional view showing an inorganic electroluminescent display device manufactured by a method according to an embodiment of the present invention.

According to a fifth embodiment of the present invention, the diffraction grid is provided at the interface between the first insulation layer 132 and the luminescent layer 142. However, the diffraction grid may be provided at the interface between second insulation layer 152 and the luminescent layer 144 as shown in FIG. 10. Also, a diffraction grid may be provided at each interface, as shown in FIG. 5.

According to embodiments of the present invention, a diffraction grid is provided at an interface between a luminescent layer and an insulation layer. Therefore, it is possible to reduce the amount of light experiencing total reflection at the interface. Also, it is possible to increase light coupling efficiency and luminance of an inorganic electroluminescent display device, as well as reduce power consumption. Consequently, the inorganic electroluminescent display device's lifespan may be lengthened.

Additionally, according to embodiments of the present invention, instead of providing a separate diffraction grid between the luminescent layer and the insulation layer, the diffraction grid may be formed by patterning an interface between the luminescent layer and the insulation layer. Therefore, it is possible to reduce the number of interfaces through which light generated in the luminescent layer must pass. Consequently, it is possible to improve light coupling efficiency and luminance.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. An inorganic electroluminescent display device, comprising:

a substrate;

a first electrode formed on the substrate;

a first insulation layer formed on the first electrode;

a luminescent layer formed on the first insulation layer;

a second insulation layer formed on the luminescent layer; and a second electrode formed on the second insulation layer, wherein a diffraction grid is provided at at least one of a first interface and a second interface, and wherein the first interface is between the first insulation layer and the luminescent layer and the second interface is between the second insulation layer and the luminescent layer, wherein at least one surface of the first insulation layer is flat, and at least one surface of the second insulation layer is flat.

2. The inorganic electroluminescent display device of claim 1, wherein the diffraction grid is formed having protrusions.

3. The inorganic electroluminescent display device of claim 1, wherein one of the first electrode and the second electrode is reflective.

4. The inorganic electroluminescent display device of claim 2, wherein one of the first electrode and the second electrode is reflective.

5. The inorganic electroluminescent display device of claim 2, wherein the protrusions have a hexahedron shape, a cylindrical shape, or a stripe shape.

6. The inorganic electroluminescent display device of claim 2, wherein an interval between the protrusions is in a range of about ¼ to about 4 times a wavelength of light generated in the luminescent layer.

7. The inorganic electroluminescent display device of claim 1, wherein a refractive index of the first insulation layer or the second insulation layer is within a range of about 1.5 to about 2.5.

8. The inorganic electroluminescent display device of claim 2, wherein a refractive index of the first insulation layer or the second insulation layer is within a range of about 1.5 to about 2.5.

9. The inorganic electroluminescent display device of claim 1, wherein the first insulation layer or the second insulation layer is made of a transparent oxide or sulfide material.

10. The inorganic electroluminescent display device of claim 2, wherein the first insulation layer or the second insulation layer is made of a transparent oxide or sulfide material.

11. The inorganic electroluminescent display device of claim 1, wherein the first insulation layer and the second insulation layer are made of a material selected from the group consisting of silicon oxide, aluminum oxide, hafnium oxide, and oxide of silicon nitride.

12. The inorganic electroluminescent display device of claim 2, wherein the first insulation layer and the second insulation layer are made of a material selected from the group consisting of silicon oxide, aluminum oxide, hafnium oxide, and oxide of silicon nitride.

* * * * *